US005340626A

United States Patent [19]

Head

[11] Patent Number: 5,340,626

[45] Date of Patent: Aug. 23, 1994

[54] WELL PACKER

[76] Inventor: Philip F. Head, 6 Leith Mansions, Grantully Road, London W9 1LQ, Great Britain

[21] Appl. No.: 44,536

[22] Filed: Apr. 7, 1993

Related U.S. Application Data

[63] Continuation-in-part of Ser. No. 927,170, Aug. 6, 1992.

[30] Foreign Application Priority Data

Aug. 16, 1991 [GB] United Kingdom ..... 9117684
Aug. 4, 1992 [GB] United Kingdom ..... 9216531

[51] Int. Cl.[5] ..... B29D 22/00; E21B 23/00

[52] U.S. Cl. ..... 428/36.9; 428/176; 428/182; 428/184; 428/188; 428/192; 428/213; 428/36.91; 166/187; 277/34

[58] Field of Search ..... 428/182, 184, 174, 36.9, 428/36.91, 192, 213, 176, 188; 166/187, 387; 277/34; 285/107, 258

[56] References Cited

U.S. PATENT DOCUMENTS 4,768,590 9/1988 Sanford et al. ..... 166/187
4,923,007 5/1990 Sanford et al. ..... 166/187

FOREIGN PATENT DOCUMENTS

91/00407 11/1991 France .

*Primary Examiner*—Donald J. Loney
*Attorney, Agent, or Firm*—Herbert Dubno; Yuri Kateshov

[57] ABSTRACT

An inflatable well packer includes several annular layers of material, consisting of a series of oriented fibers encapsulated in a resin, the fibers being oriented in directions relative to the direction of the circumference of the annular layers such that pressure from the bore through the annular layers causes changes to the orientations of the fibers, thus causing inflation of the well packer, the fibers within each layer being oriented along the length of the layer, so that a portion of them are oriented at the lock up angle.

9 Claims, 5 Drawing Sheets

WELL PACKER

CROSS REFERENCE TO RELATED APPLICATIONS

This is continuation-in-part copending application Ser. No. 07/927,170 filed Aug. 6, 1992 and based upon a British Application 9117684.2 filed Aug. 16, 1991 and 9216531.5 filed Aug. 4, 1992 under 35 USC 119 and the International Convention.

FIELD OF THE INVENTION

This invention relates to well packers. In particular, the invention relates to inflatable well packers, which in use are inflated by fluid under pressure to isolate a zone in a well.

BACKGROUND OF THE INVENTION

Inflatable well packers have been known for many years, the packers being used to isolate a zone in a well, so as, for example to enable a drill stem test to be performed, to perform a selective chemical treatment, or to isolate a redundant Zone in a productive well. There are presently two types of inflatable well packers, each being of a multilayered construction including an elastomeric inner bladder, but varying in the bearing system incorporated in the packer. The first type of known well packer includes wire or textile fibers, woven together with their ends secured to end fittings by an epoxy potting process, the sheath of woven wire or fibers being covered in an outer elastomeric boot which will form a hydraulic seal to the casing, or open-hole surface of a wall which the well packer will, in use, isolate. The other type of inflatable well packer utilises long, peripherally overlapping strips of spring steel which, when the packer is inflated, slide radially against each other like Venetian blinds, the strips surrounding the elastomeric inner bladder. The central portions of the strips are bonded to an outer annular elastomeric boot which acts as a hydraulic seal to the casing or open-hole surface in use of the well packer. An example of a well packer of this type is shown in U.S. Pat. No. 3160211.

With either of these known well packers there are a number of shortcomings. Firstly, the manufacture of either of these well packers is labour intensive. In the case of the woven sheath reinforced well packer, the reinforcing wire or fabric has to be hand-woven during assembly of the well packer. In the case of the spring steel strip reinforced well packer, the large number of overlapping strips are difficult to assemble and engage in their end fittings.

Furthermore, In either of the known types of well packers, the elastomeric inner bladder has to expand typically by twice the amount that the outer elastomeric boot has to expand. Thus if the packer has to be inflated by a ratio of 3:1 in order for the outer boot to make the required seal, the inner elastomeric bladder will have to expand by a ratio of 6:1. This results in the inner elastomeric bladder in its inflated state being very thin, thus making the inner elastomeric bladder susceptible to any micro faults which it may have in its structure. Furthermore, the high expansion ratio required by the inner elastomeric bladder severely limits the choice of materials which may be used. As a result of the limited choice of materials, the inner elastomeric bladder tends to have a very limited chemical resistance to any fluid other than water, thus limiting the life of the packer when the packer is exposed to fluids such as acids, solvents, diesel oil, and surfactants, these all being chemicals which are commonly required for treatments of zones within wells.

With regard to the outer elastomeric boot in either of the known types of well packers, although this typically only has to expand by a ratio of 3:1, and thus an increased choice of materials enables it to have a better chemical resistance to the fluids used in the wells than that of the inner elastomeric bladder, the outer elastomeric boot still has a relatively short life span.

Finally, there is a further drawback to such known inflatable well packers, in that when they are expanded they exert a high radial stress on the end fitting as they try to expand to a diameter greater than the diameter of the end fitting. This puts a complex compressive stress on the outer reinforcing members of either type of well packer, and furthermore, exerts a high tensile stress on the reinforcing members inner surface. In some cases this has resulted in a splitting of the end fitting, this then releasing the well packer into the well bore.

OBJECT OF THE INVENTION

It is therefore an object of the present invention to provide a well packer avoiding problems of unproportional expansion of the outer boot and inner bladder as well as avoiding a high radial stress on the end fitting by optimizing a lock up angle of at least one layer upon the expansion.

SUMMARY OF THE INVENTION

According to a first aspect of the present invention there is provided an inflatable well packer comprising at least one annular layer of material wherein at least a portion of the layer of material comprises fibers which are orientated at various angles such that when is in the inflated state at least a portion of the fibers are orientated at the lock up angle, being 54° 40′.

Thus, in such a well packer the need for an elastomeric inner bladder and an outer elastomeric boot can be avoided. Furthermore the corrugations enable the differential radial stress present in known well packers to be at least reduced relative to the equivalent expansion ratios of known inflatable well packers.

Preferably the layer or layers of material comprise a series of fibers encapsulated in a resin. The resin encapsulates the fibers on the inside and outside. The thickness of resin is preferably greater on the inside of the fibers compared to the outside.

It is advantageous for the angle of orientation of the fibers with respect to the length of the layer to vary along the length of the layer.

It is also preferable, for there to be a plurality of layers. Where there are a plurality of layers, at least a portion of the fibers within each layer are suitably oriented along the length of the layer such that adjacent layers comprise fibers which are wound in opposite directions. It is also preferable for adjacent layers to comprise fibers which are wound at different angles.

According to the invention the angles of orientation of the fibers are such that when the packer is inflated, fibers in adjacent layers will lock up so as to oppose further expansion.

The edges of the layers will usually be clamped by a respective end fitting. In such a case, preferably the fibers in the regions of the layers adjacent to the end fittings will be orientated at angles close to or the same as the lock up angle so little or no expansion is permitted at that point.

BRIEF DESCRIPTION OF THE DRAWING

The above and other objects, features and advantages will become more readily apparent from the following description, references being made to the following accompanying drawing in which.

SPECIFIC DESCRIPTION

Figure 1:
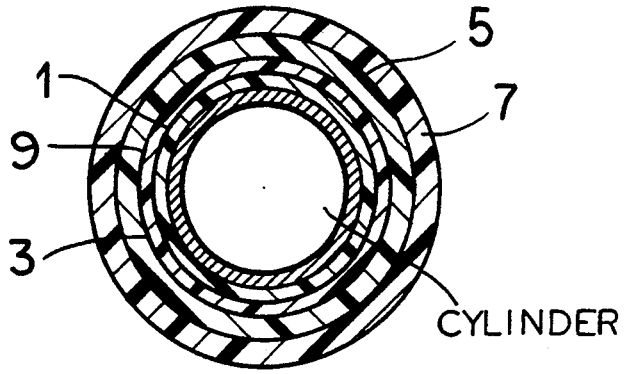
FIG. 1 is a cross-section of the well packer in accordance with an embodiment of the invention.
Figure 8:
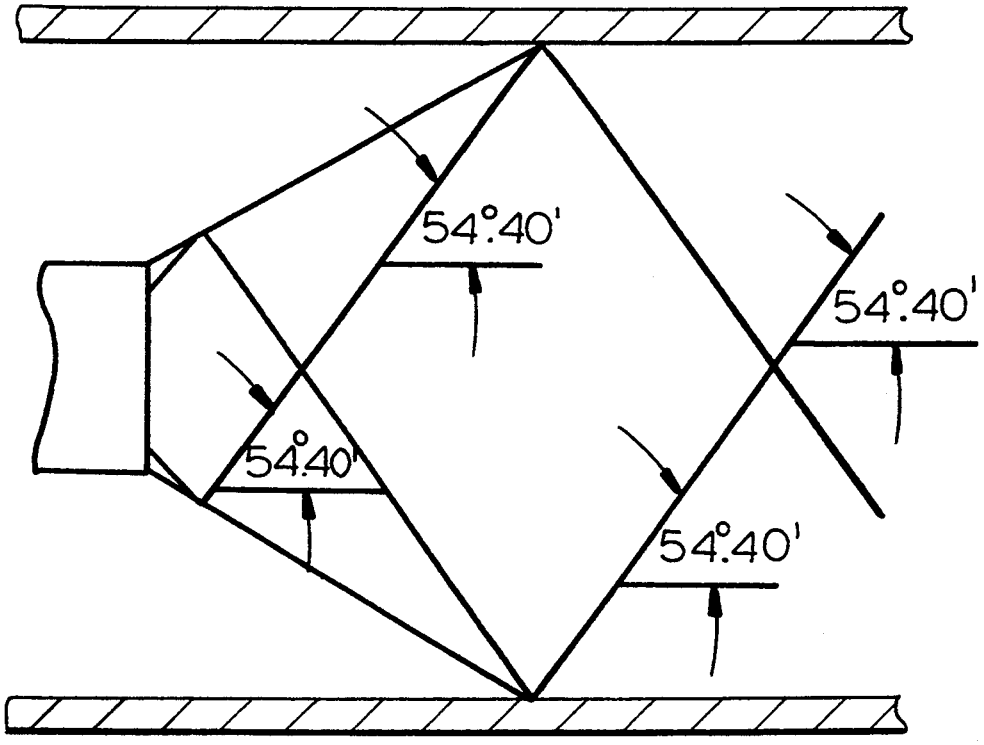
FIG. 8 is a detailed view of the formation of the lock up angles of FIG. 7.
Figure 2:
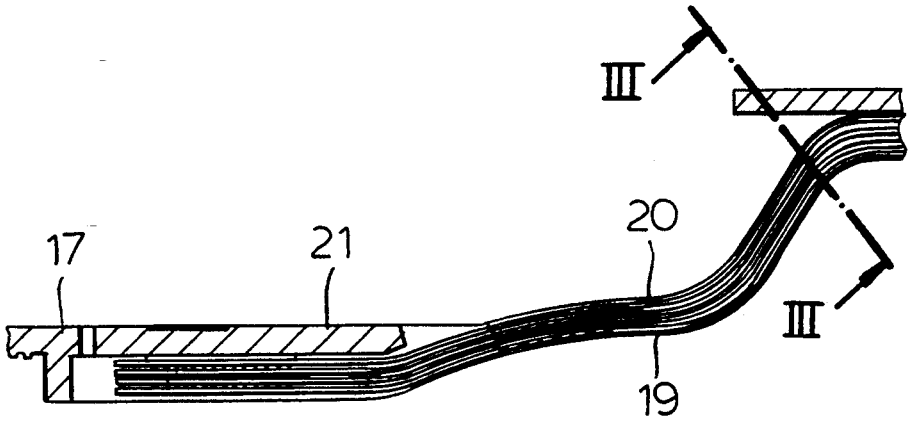
FIG. 2 is a schematic side view of part of the well packer in the region of the end fitting in the inflated state.

Referring firstly to FIG. 1 , the first well packer in accordance with an embodiment of the invention to be described comprises four concentric reinforcing fiber layers 1,3,5,7 encapsulated in an elastomeric resin 9. The edges of the layers 1,3,5,7 are secured by respective end fittings, shown in FIG. 2.

The term fibers includes any longitudinally orientated elements which can be comprised of any suitable material which exhibits the required strength in the longitudinal direction. This includes for example carbon or glass fibers and also steel wire type fibers.

The fibers for each of the layers are variably oriented along the length of the packer such that their orientations when the packer is inflated describe a helix, with the orientations of the fibers in adjacent layers 1,3,5,7 being in opposite senses. At each of these shoulder portions 19,20, the fibers within each layer 1,3,5,7 are oriented in their fully extended position or lock up position in the inflated state. This thus avoids the differential stresses which occur in the prior art well packers.

Before proceeding to describe the proposed packers of the invention, it is necessary to demonstrate the properties of armoured rubber hoses reinforced with plies of helically disposed wires or fibers.

Referring to the packer of FIG. 1 comprising two plies of helically-wound steel cables. The radius of the cylinder is r (thickness neglected). In both plies the cables form the same angle δwith the generatrices of the cylinder but in one ply they follow right-handed helices and in the other, left-handed helices. Assuming that the length (h) of the cylinder is such that the helices are just one pitch long so that:

$$h = \frac{2\pi r}{\tan\delta}$$

With the ends of the cylinder closed and the pressure within increased, if δ is small or nil, the cylinder will tend to grow in diameter and reduce in length; whereas if δ is close to 90°, it will tend to grow in length and reduce in diameter. In both cases the volume inside the cylinder increases, but the bases of the cylinder do not tend to twist because of the balancing action of the two symmetrical plies. For a certain value of δ the cylinder will neither swell nor lengthen when inflated because any pressure change would not increase its volume. The value of this angle is calculated as follows:

The volume v of the cylinder is:

$$v = \pi r^2 \times \frac{2\pi r}{\tan\delta} = 2\pi^2 \times \frac{r^3}{\tan\delta} \quad (1)$$

The length L of the cable is as follows:

$$L^2 = 4\pi^2 r^2 \times \left(1 + \frac{1}{\tan 2\delta}\right) = \frac{4\pi^2 \times r^2}{\sin^2\delta} \quad (2)$$

As the cables are essentially inextensible any change in the length must be zero, so.

$$dL = 4\pi^2 r^2 \times \frac{rdr}{\sin^2\delta} - 4\pi^2 \times \frac{r2\cos\delta}{\sin^3\delta} = 0$$

which leads to:

$$\frac{dr}{r} = \frac{d\delta}{\tan\delta} \quad (3)$$

The volume change as a function of radius and angle δ is:

$$dV = 2\pi^2\left(\frac{3r^2dr}{\tan\delta} - \frac{r^3d\delta}{\sin^2\delta}\right)$$

and dV will be zero if:

$$\frac{3dr}{\tan\delta} = \frac{rd\delta}{\sin^2\delta} \text{ or } \frac{dr}{r} = \frac{d\delta}{3\mathrm{Cos}\delta\mathrm{Sin}\delta} \quad (4)$$

Equations (3) and (4) are simultaneously satisfied for one value δo of δ.

$$\frac{1}{\tan\delta o} = \frac{1}{3\mathrm{Cos}\delta o\mathrm{Sin}\delta o}$$

hence:

$3\mathrm{Cos}^2\delta o = 1$ $$\mathrm{Cos}\ \delta o = \frac{1}{\sqrt{3}}$$

or $\tan\delta 0 = \sqrt{2}$

It can therefore be concluded that the ideal value of the helix angle for no expansion or swelling of the reinforced packer is $\delta = \delta o = 54°\ 40'$.

Where the helix angles of a set of helically oriented fibers are oppositely directed to the fibers in an adjacent layer, and the fibers in the adjacent layers are at the lock-up angle of 54° 40', if internal pressure is applied to the layers, then the fibers within the two layers will lock-up preventing further expansion.

Thus in the well packer of the present invention, a large radial tensile stress is prevented at the entrance 21 to the end fitting 17 as would be the case in conventional well packers. In the well packer, the fibers are variably oriented along the length of the packer in the packers uninflated state. Thus, as the packer is inflated the fibers will try to change their helical angle relative to the longitudinal axis of the packer up to the maximum angle of 54° 40′, at which point the fibers in adjacent layers will lock up. In order to reduce the expansion of the layers close to the end fittings 17, the initial helix angle before expansion of the well packer is arranged to be at least 54° 40′, so that the packer does not expand by a large amount before the interaction of the adjacent layers causes locking up.

FIGS. 6 to 9 show that as the distance of the fibers from the end fittings 17 increases, the fiber helix angle is reduced such that the amount by which the fibers can be displaced is increased, thus causing a corresponding expansion of the packer. Thus control of the orientation of the fibers along the length of the packer provides a corresponding control of the amount which the various regions of the packer can expand, the inflated expansion profile having a uniform stress distribution.

Figure 3:
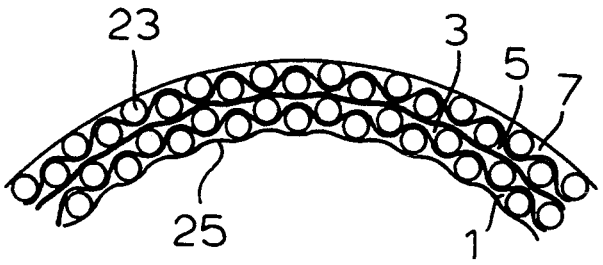
FIG. 3 is a schematic cross section on an expanded scale along the line IV—IV of the reinforcing fibers shown in FIG. 2.
Figure 4:
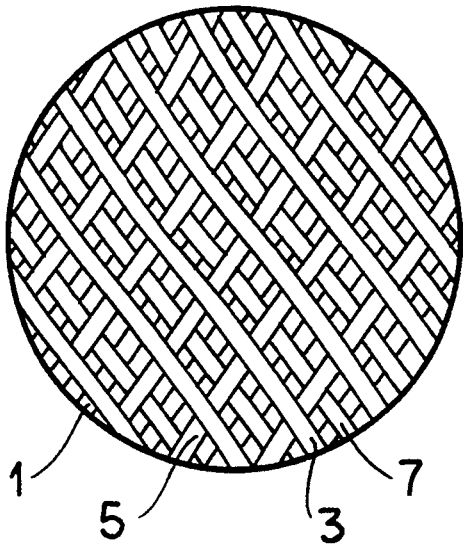
FIG. 4 is a plan view in detail of the reinforcing fibers of FIG. 3, the view being shown on an enlarged scale.
Figure 5:
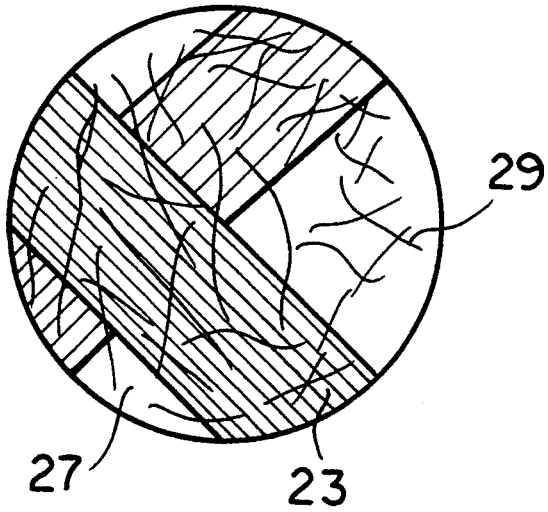
FIG. 5 is an enlarged view of a part of the reinforcing fibers of FIG. 4.

The composition of the layers 1,3,5,7 is shown in more detail in FIGS. 3, 4 and 5. Referring firstly particularly to FIG. 3, when the well packer expands, the fibers 23 within each of the layers 1,3,5,7 move away from each other, causing necking of the inner circumferential surface of the well packer as a result, as indicated at 25 in FIG. 3, the outer surface of the packer being constrained into a cylindrical configuration by the lining 15 of the steel casing.

Figure 6:
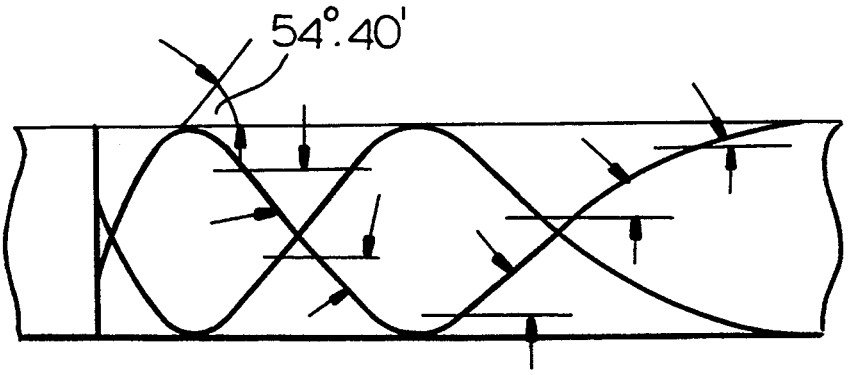
FIG. 6 is a schematic view of the orientation of the fibers near the end fitting.
Figure 7:
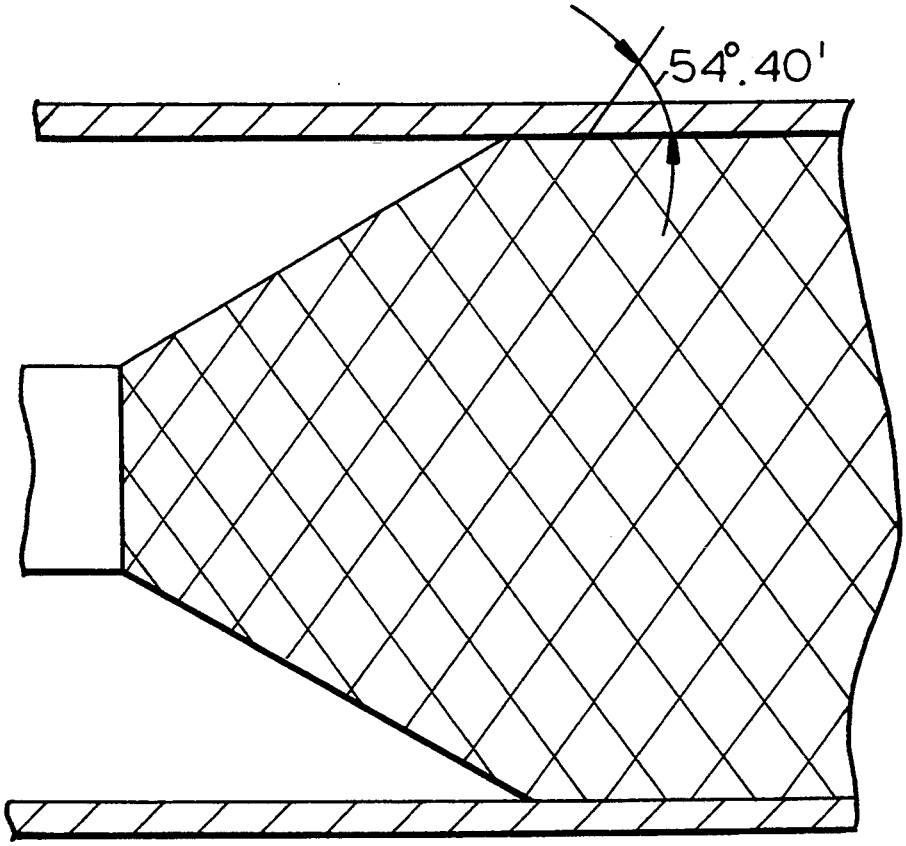
FIG. 7 is a schematic view showing the formation of the lock up angles.
Figure 9:
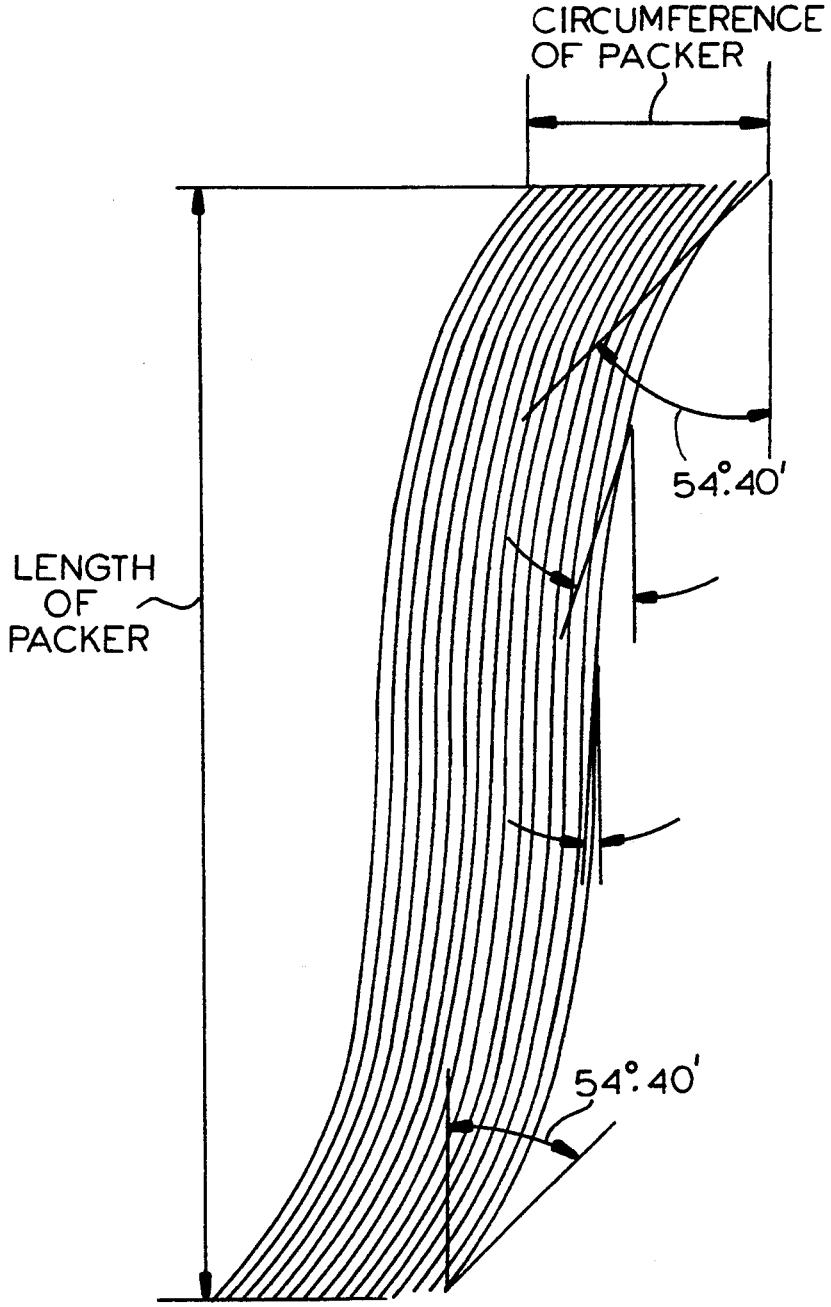
FIG. 9 is the orientation of the fibers along the length of the packer before inflation of the packer.

Referring to FIG. 6 in particular it can be seen that as the packer is inflated the layers expand. This occurs first at the end fitting where the fibers are already close to the lock up angle. As the pressure increases subsequent fibers further away from the end fitting orientate themselves further until they reach the lock up angle. This process continues until the desired extent of inflation is reached and/or until the lock up angles are achieved for essentially all the fibers along the length of the packer.

It will be appreciated that the more layers of fibers incorporated within the well packer, the finer will be the resulting mesh distribution, and the less will be the unsupported regions 27 shown in FIG. 5, between the fibers 23. In order to reduce the number of unsupported regions 27 which may occur, it may be advantageous to include short fiber reinforcements 29 in the elastomeric matrix as indicated in FIG. 6. When the well packer is inflated, these short fibers 29 will maintain the links between the fibers 23, thus providing a bridging action over the unsupported regions 27 when the well packer is expanded. Suitable materials for the fibers 29 include glass fibers and short Kevlar fibers. The fibers 29 will also perform a memory function, helping the well packer to recover to its non-inflated form after inflation.

Fibers in adjacent layers can vary in the angle of orientation to the length of the packer as well as having a varying angle of orientation within each layer.

It will be appreciated that whilst in each of the embodiments of the well packer described here before by way of example, there are four layers of reinforcing fibers, a well packer in accordance with the invention may have any number of layers, including a single layer, although multiple layers are advantageous. Where a single layer of reinforcing fibers is used, the fibers have to be bi-directionally interlaid at a varying orientation so that the interlocking function can be achieved in the single layer and in addition the use of the short fibers 29 to bridge the gaps between the reinforcing fibers, when the well packer is in an expanded state, is particularly advantageous.

It will also be appreciated that whilst in the particular well packers in accordance with embodiments of the invention, described hereinbefore, the encapsulating resin is an elastomeric material, a well packer in accordance with the invention enables the use of encapsulation resins other than elastomeric, thus allowing the selection of highly resilient material with good resistance to the well bore and treatment fluids. Suitable alternative encapsulation resins are fluoroplastics such as PTFE or FEP, which are sold under the trade names Teflon and Xynar, or polyphenylene sulphide such as PPS, which is sold under the trade names Ryton and SUPEC. All of these materials have limited elastic properties, but do have good chemical resistance of the chemical, pressure, and temperature conditions in which the well packer is likely to be required to operate. Where a non-elastomeric material is chosen for the encapsulating resin, the use of the short reinforcing fibers 29 to provide a memory function to help recovery of the well packer to its non-inflated state is particularly advantageous.

I claim:

1. An inflatable packer comprising:

a pair of spaced apart end fittings and an expandable elongated annular member extending between the end fittings along a longitudinal axis of the packer, said member comprising:

at least one annular layer of material having an outer circumference and an inner surface, at least a portion of the material being provided with fibers, and an elastomer encapsulating the fibers of the portion of the material, the member being expanded from a deflated position to an inflated position to form a seal upon building up of pressure in the member bore, at least part of the fibers in the inflated position being oriented along a helix having a helical pitch angle of 54° 40′ relative to the longitudinal axis and equivalent to a lock up angle.

2. The inflatable packer defined in claim 1 wherein said elastomer encapsulates the fibers from inside and outside, a thickness of the elastomer encapsulating the fibers on the inside being greater than a thickness of the elastomer on the outside of the fibers.

3. The inflatable packer defined in claim 1 wherein the member comprises at least two annular layers each defining a respective helix in the direction of the circumference 14.

4. The inflatable packer defined in claim 1, further comprising separating means for separating the annular layers.

5. The inflatable packer defined in claim 4 wherein the separating means includes a polytetrafluoroethylene layer 16.

6. The inflatable packer defined in claim 3 wherein the layers are formed from a common encapsulating material.

7. The inflatable packer defined in claim 3 wherein each of the layers is formed with a respective portion of longitudinally extending fibers forming a respective helix in the direction of the circumference in the inflated position.

8. The inflatable packer defined in claim 1 wherein the fibers are oriented with respect to the longitudinal axis of the packer at an angle varying along said direction.

9. The inflatable packer defined in claim 3 wherein the layers are provided with respective fibers wound in opposite directions and at respective different angles with respect to the longitudinal axis of the packer.

* * * * *